US009856718B2

(12) United States Patent
Broussard

(10) Patent No.: US 9,856,718 B2
(45) Date of Patent: Jan. 2, 2018

(54) METHOD AND APPARATUS FOR SELECTIVE INJECTION

(71) Applicant: Weatherford Technology Holdings, LLC, Houston, TX (US)

(72) Inventor: John Patrick Broussard, Montgomery, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 488 days.

(21) Appl. No.: 14/542,441

(22) Filed: Nov. 14, 2014

(65) Prior Publication Data

US 2016/0138366 A1 May 19, 2016

(51) Int. Cl.
*E21B 34/14* (2006.01)
*E21B 23/02* (2006.01)
*E21B 34/00* (2006.01)

(52) U.S. Cl.
CPC ..... *E21B 34/14* (2013.01); *E21B 23/02* (2013.01); *E21B 2034/005* (2013.01); *E21B 2034/007* (2013.01)

(58) Field of Classification Search
CPC ..... E21B 33/134; E21B 34/14; E21B 23/02
See application file for complete search history.

(56) References Cited

U.S. PATENT DOCUMENTS 4,729,432 A 3/1988 Helms
5,141,056 A 8/1992 Tailby
5,464,059 A 11/1995 Kristiansen
6,158,510 A 12/2000 Bacon et al.
6,260,622 B1 7/2001 Blok et al.
7,404,439 B2 7/2008 Schuh
7,950,468 B2 5/2011 Horton
8,256,523 B2 9/2012 Horton
2003/0127227 A1* 7/2003 Fehr ..... E21B 33/124 166/306
2011/0226478 A1 9/2011 Horton
2014/0209306 A1* 7/2014 Hughes ..... E21B 23/02 166/279

FOREIGN PATENT DOCUMENTS

WO 2009146563 A1 12/2009

OTHER PUBLICATIONS

Canadian Office Action dated Sep. 19, 2016, for Canadian Patent Application No. 2,912,239.

* cited by examiner

*Primary Examiner* — Giovanna C Wright
*Assistant Examiner* — Kristyn Hall
(74) *Attorney, Agent, or Firm* — Patterson + Sheridan, LLP

(57) ABSTRACT

A method and apparatus for selectively treating different zones in a wellbore includes running a tubular string into the wellbore, the string having at least two housings disposed therein, the housings separated along the string, each housing having a fluid path between an interior of the housing and a zone of interest and each housing having an individual profile for mating with an individual insert and running a second, smaller diameter tubular string into the wellbore, the string including an insert, the insert constructed and arranged to mate with a predetermined one of the plurality of housings and to initially seal the fluid path.

25 Claims, 9 Drawing Sheets

METHOD AND APPARATUS FOR SELECTIVE INJECTION

BACKGROUND OF THE INVENTION

Field of the Invention

Embodiments of the present invention generally relate to a method and apparatus for injecting material, like steam into predetermined zones surrounding a wellbore.

Description of the Related Art

The present invention relates to the selective treatment of wellbore zones, typically by the injection of steam. Traditional means of injecting steam to various locations in a wellbore means placing valves in a tubular string and then opening the valves by shifting sleeves with wireline. However, in steam injection wells there are working limits regarding bottom hole temperature and surface temperature as to when wireline can be used. High temperatures in these type wells can reduce the tensile strength of the wire and high surface pressure and temperature of steam can be very hazardous to service personnel required around the wellhead. There is a need therefore, for a new and improved way to inject steam at various predetermined locations in a wellbore.

SUMMARY OF THE INVENTION

The present invention includes methods and apparatus for selectively treating different zones in a wellbore. In one embodiment, a method is performed by running a tubular string into the wellbore, the string having at least two housings disposed therein, the housings separated along the string, each housing having a fluid path between an interior of the housing and a zone of interest and each housing having an individual profile for mating with an individual insert; running a second, smaller diameter tubular string into the wellbore, the string including an insert, the insert constructed and arranged to mate with a predetermined one of the plurality of housings and to initially seal the fluid path; mating the insert to the predetermined housing, thereby sealing the fluid path; dropping an object from the surface of the well, the object constructed and arranged to land in a ball seat formed in the insert; using fluid pressure to open the fluid path and injecting material into the zone, via the fluid path.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
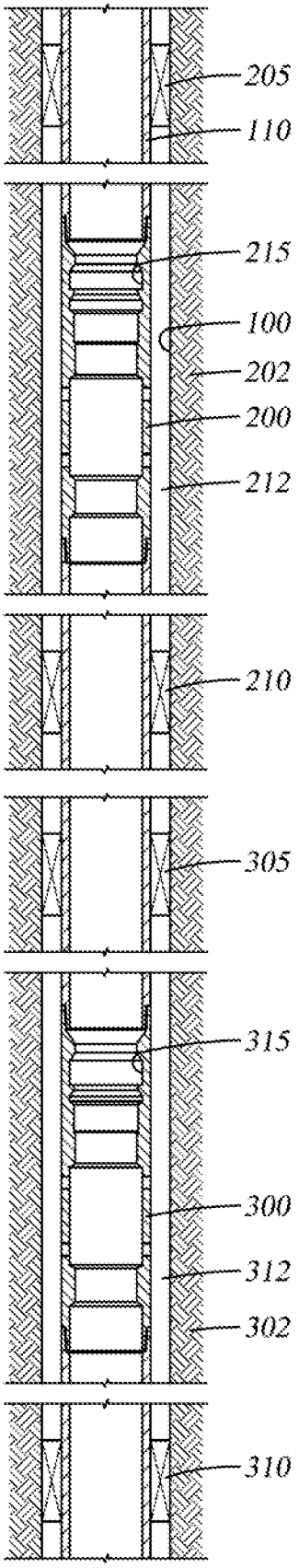
FIG. 1 is a section view of a wellbore with a production string disposed therein.

FIG. 1 is a section view of a wellbore 100 with a production string 110 disposed therein. As illustrated, the production string includes an upper 200 and lower 300 housing installed at predetermined locations where they will each be adjacent an area of interest or zone (e.g., 202, 302). Packers 205, 210, 305, 310 are used to isolate annular areas (e.g., 212, 312) between the housings and the zones. As will be explained in more detail, each housing (e.g., 200, 300) includes an internal profile (e.g., 215, 315) designed to interact and mate with corresponding outer profiles of a particular wellbore flow control insert (not shown) and permit other wellbore flow control inserts with different outer profiles to pass by on their way to another housing located at a lower place in the production string 110.

Figure 2:
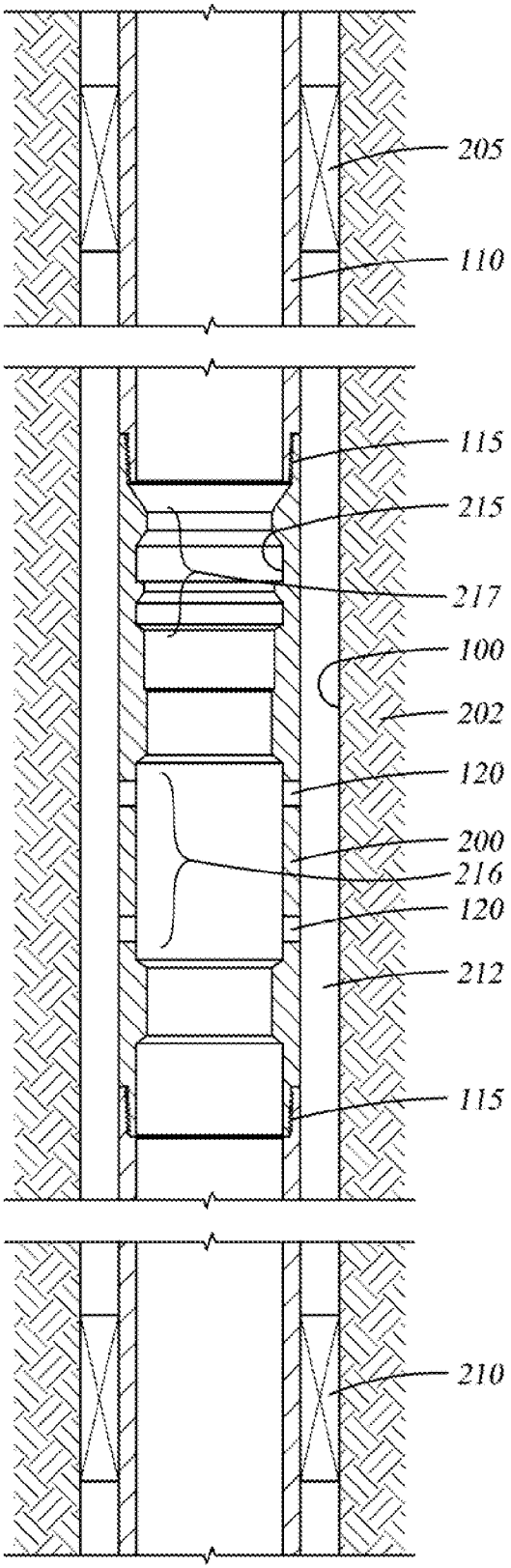
FIG. 2 is a section view of the wellbore of FIG. 1 showing an upper housing in greater detail.

FIG. 2 is a section view of the wellbore 100 of FIG. 1 showing upper housing 200 (first housing) in greater detail. At each end is a threaded connection 115 permitting the upper housing 200 to be installed in the production string 110 at a predetermined location below and above adjacent wellbore elements in a wellbore string. Each upper or first housing includes a first tubular housing side port portion 216 including a number of ports (e.g., 120, extending between and inner surface and an outer surface of the upper (first) housing) that initially permit fluid communication between an interior of the housing and the isolated annular area 212 created between the upper and lower packers 205, 210. The packers are typically the type run in to the wellbore with production string and then remotely actuated after the string is installed. In one embodiment, the packers have elements that are expandable outwardly to contact and seal a space between the packer and the wellbore 100 wall.

An inner profile 215 (constituting a first tubular housing key receiving engagement portion 217) formed in the upper housing 200, is constructed to have a first tubular housing insert spring loaded key element engaging contour on an inner surface of the first tubular housing which is arranged to mate with spring loaded mating keys formed on an wellbore flow control insert to be installed prior to treating the upper zone.

Figure 3:
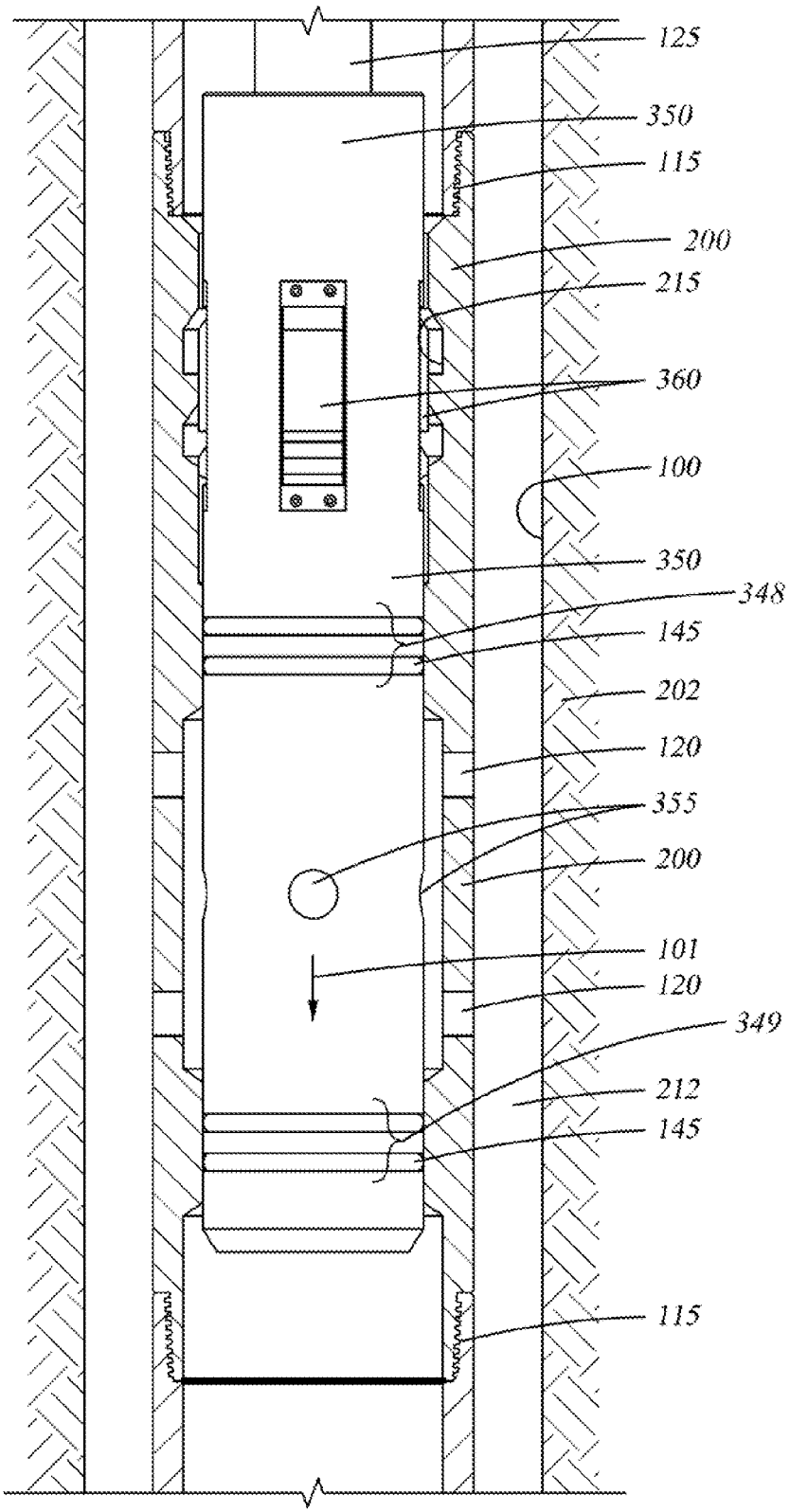
FIG. 3 is a partial section view of the wellbore showing the upper housing of FIG. 2 and also illustrating the insertion of a lower wellbore flow control insert.

FIG. 3 is a partial section view of the wellbore 100 showing the upper housing 200 of FIG. 2 and also illustrating the delivery of a lower wellbore flow control insert 350 through the bore of the upper housing 200. The wellbore flow control inserts (e.g., 250, 350) are run in to the production string on their own string 125 of tubulars. In the embodiment shown, the run in string 125 is coiled tubing, but the wellbore flow control inserts could be run in on any type of string (including wireline) that allows a tool like the wellbore flow control insert be run in to a wellbore, disconnected from the string and left downhole to be utilized in an operation and then be removed at a later time. Each wellbore flow control insert includes a set of spring loaded keys (e.g., 260, 360) having key profiles formed thereon for mating with a particular housing. In the example shown in FIG. 3, the profiles formed on the spring-loaded keys 360 of the lower wellbore flow control insert do not fit the inner profile 215 formed on the interior surface of the upper housing 200. Consequently, the lower wellbore flow control insert 350 moves downwards (shown by arrow 101) through upper housing 200 with no engagement or interference between the potentially corresponding profiles of the keys and inner surface of the upper housing 200.

Figure 4:
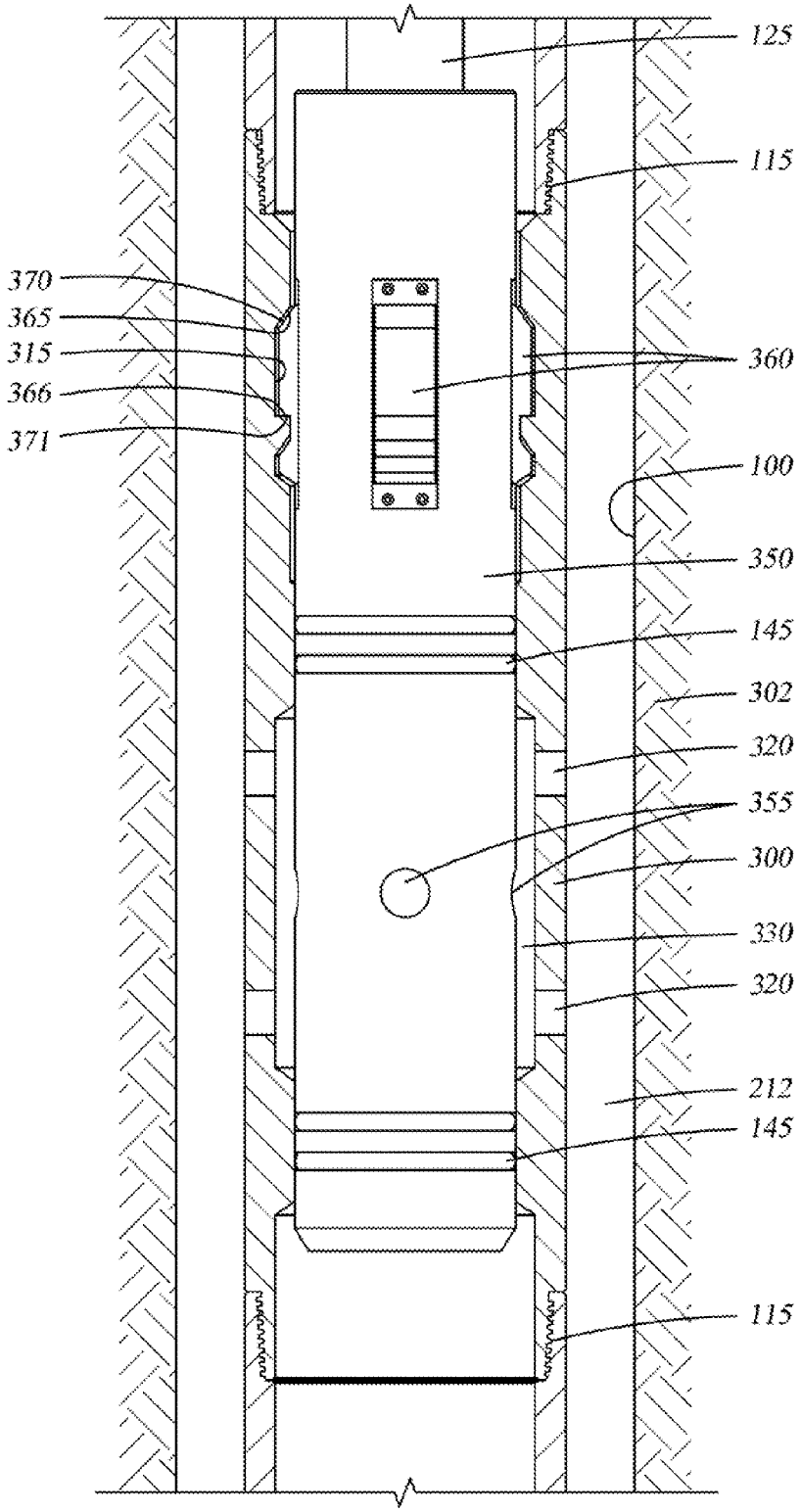
FIG. 4 is a view, partially in sections, showing the lower housing and the lower wellbore flow control insert installed in the housing.

FIG. 4 is a view, partially in section, showing the lower housing 300 and the lower wellbore flow control insert 350 installed in the lower housing 300. As shown, the profiles on the spring-loaded keys 360 have found mating profiles (e.g., 315) in the lower housing 300, permitting the spring-loaded keys 360, urged by springs 361 (not shown) to extend outwards and into the lower housing inner profile 315. In particular, the lower wellbore flow control insert 350 is prevented from further downward movement by shoulders 366, 371 formed on the spring-loaded keys 360 and lower housing 300. In the installed position of FIG. 4, apertures 355 formed in the lower wellbore flow control insert 350 are positioned to provide fluid communication from an interior of the housing to the ports 320 formed in the lower housing 300 via an annular space 330 between the lower wellbore flow control insert 350 and the lower housing 300.

Figure 5:
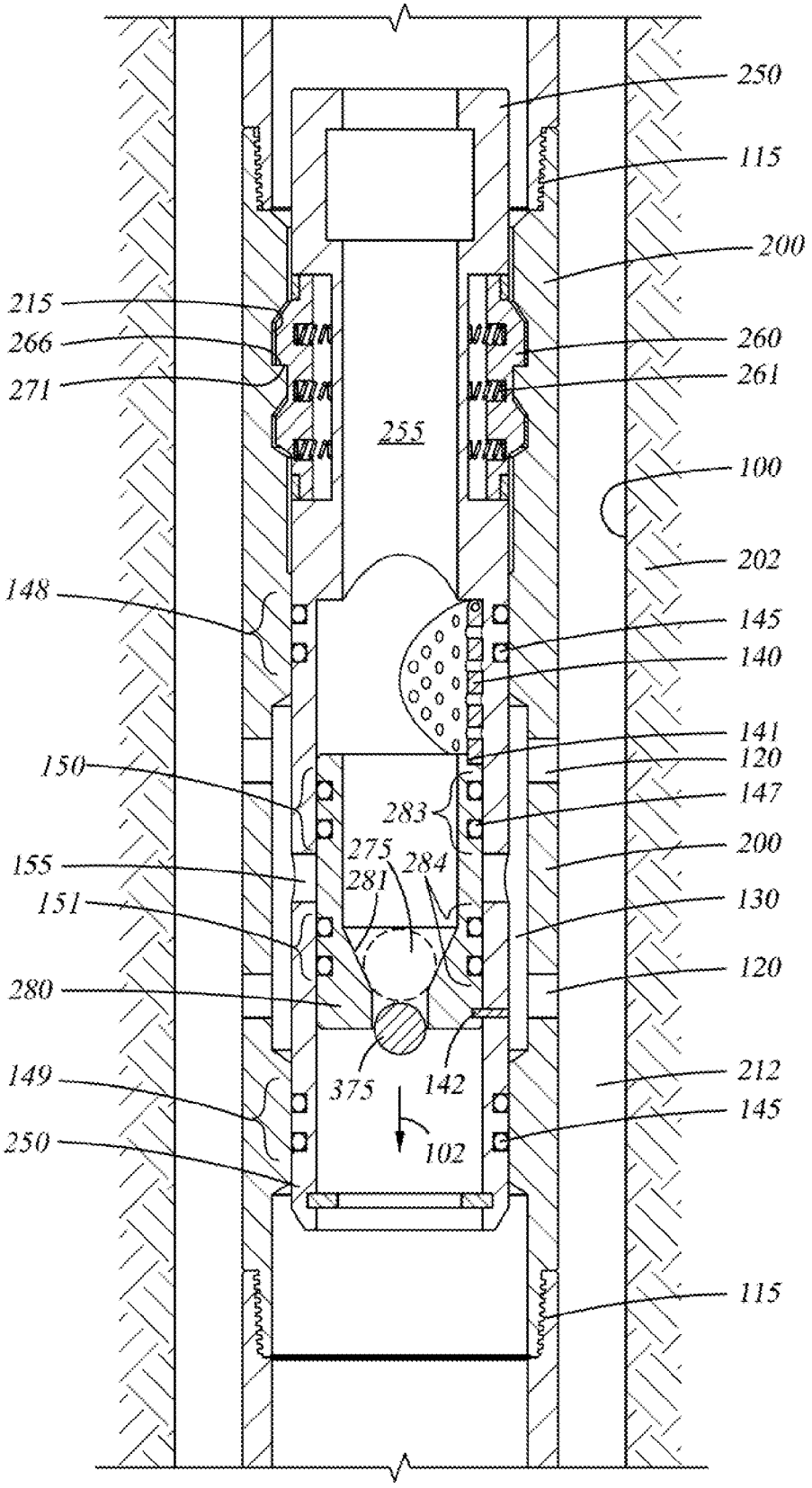
FIG. 5 is a section view of the wellbore showing the upper wellbore flow control insert installed in the upper housing.

FIG. 5 is a section view of the wellbore 100 showing the upper wellbore flow control insert 250 installed in the upper housing 200. The spring-loaded keys 260 (each having a plurality of springs 261 therein) with their outwardly facing profiles are mated with profiles of the housing, preventing downward movement of the wellbore flow control insert due to the interfering shoulders 266, 271. With the lower wellbore flow control insert 350 installed, the run in string 125, visible in FIG. 4, has been removed through the use of a remotely actuatable latch (not shown) typically operable with rotation of the run in string.

Each wellbore flow control insert includes a ball sleeve flow control insert plug and in FIG. 5, upper ball sleeve flow control insert plug 280 of upper wellbore flow control insert 250 is shown in its initially side port closed position. In the side port closed position, the walls of the upper ball sleeve flow control insert plug 280 block a fluid path that would otherwise permit fluid communication between an interior (an upper insert bore 255) of the upper wellbore flow control insert 250 and the upper zone 202 via apertures 155, annular space 130, ports 120 and the upper isolated annular area 212 between upper and lower packers (not shown). O-ring seals 145 positioned in O-ring grooves in a first tubular housing outer surface side port upper sealing portion 148 of the upper tubular wellbore flow control insert 250 and a first tubular housing outer surface side port lower sealing portion 149 of the upper tubular wellbore flow control insert, and O-ring seals 147 positioned in an upper tubular ball sleeve flow control insert plug outer surface side port upper sealing portion 150 and an upper tubular ball sleeve flow control insert plug outer surface side port lower sealing portion 151 are used to seal between the upper housing 200 and wellbore flow control insert 250 and between the upper wellbore flow control insert 250 and the upper ball sleeve flow control insert plug 280.

The upper ball sleeve flow control insert plug 280 is retained in its initial closed position by an upper shear pin 142 temporarily anchoring the sleeve to the upper wellbore flow control insert 250. Formed in a lower end of the sleeve is a ball seat 281 constructed and arranged to receive a ball of predetermined diameter while permitting balls of a smaller diameter to pass through the wellbore flow control insert without being "caught" by the ball seat. Once a ball is seated in the ball seat 281, a fluid path through the sleeve is blocked and fluid pressure can be applied to the ball and ball seat in order to shear the shear pin 142 and move the sleeve to a lower "open" position. Shear pins are commonly used to temporarily hold a movable downhole component in an axial position but any number of devices can be used and are well known in the art, requiring only that movement of the component selectively possible from the surface of the well.

Figure 7:
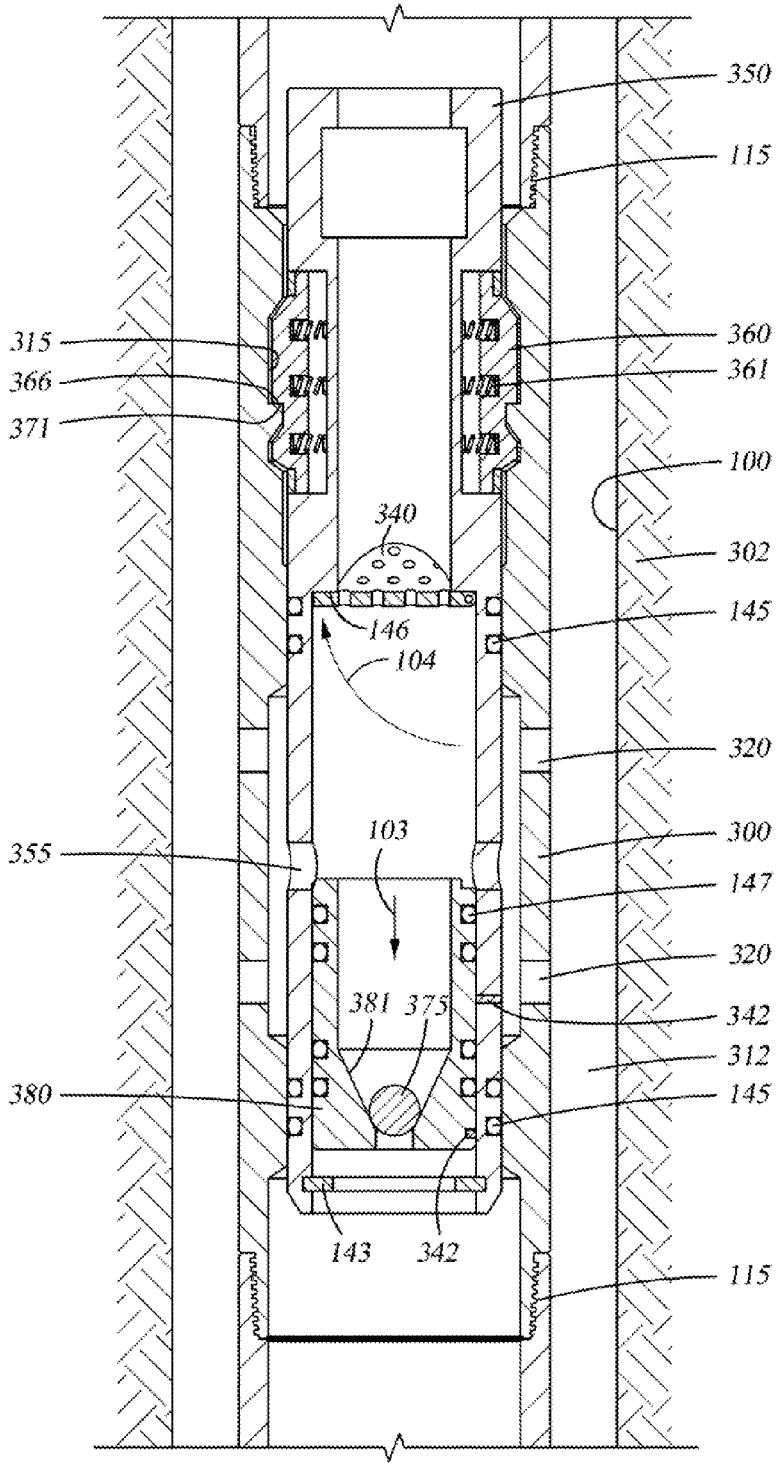
FIG. 7 is a section view of the components of FIG. 6 and illustrates the lower ball seat as it moves between its initial closed position to an open position.

In FIG. 5, a smaller diameter ball 375 is shown passing through the larger diameter ball seat 281 of the upper wellbore flow control insert 250. The movement of the smaller diameter ball 375 is shown by directional arrow 102. By using balls and ball seats of different diameters, the ball sleeves of the various wellbore flow control inserts (e.g., 250, 350) can be opened sequentially, permitting selective operation to be performed on certain zones. In FIG. 5, for instance, the smaller diameter ball 375 is shown moving through the larger diameter ball seat 281 of the upper wellbore flow control insert on its way to a wellbore flow control insert at a lower place in the production string with a mating-sized ball seat. Shown in dashed lines is a larger diameter ball 275 which, when dropped from the surface, will be caught by the larger diameter ball seat 281 of the upper wellbore flow control insert 250, permitting the upper ball sleeve flow control insert plug 280 to be moved to an open position. Disposed in an interior of the wellbore flow control insert is a spring-loaded flapper 140 that is biased toward a closed position. The flapper is held in its initial, open position due to a shoulder 141 formed at an upper end of the upper ball sleeve flow control insert plug 280 whereby, as the sleeve moves downward, a spring-loaded flapper 340 will close (FIG. 7). In the embodiment shown, the central bore through the insert is sealed with a ball and ball seat but it is contemplated that sealing the bore could be performed any number of ways so long as the sealing is remotely accomplished and the bore is initially open.

Figure 6:
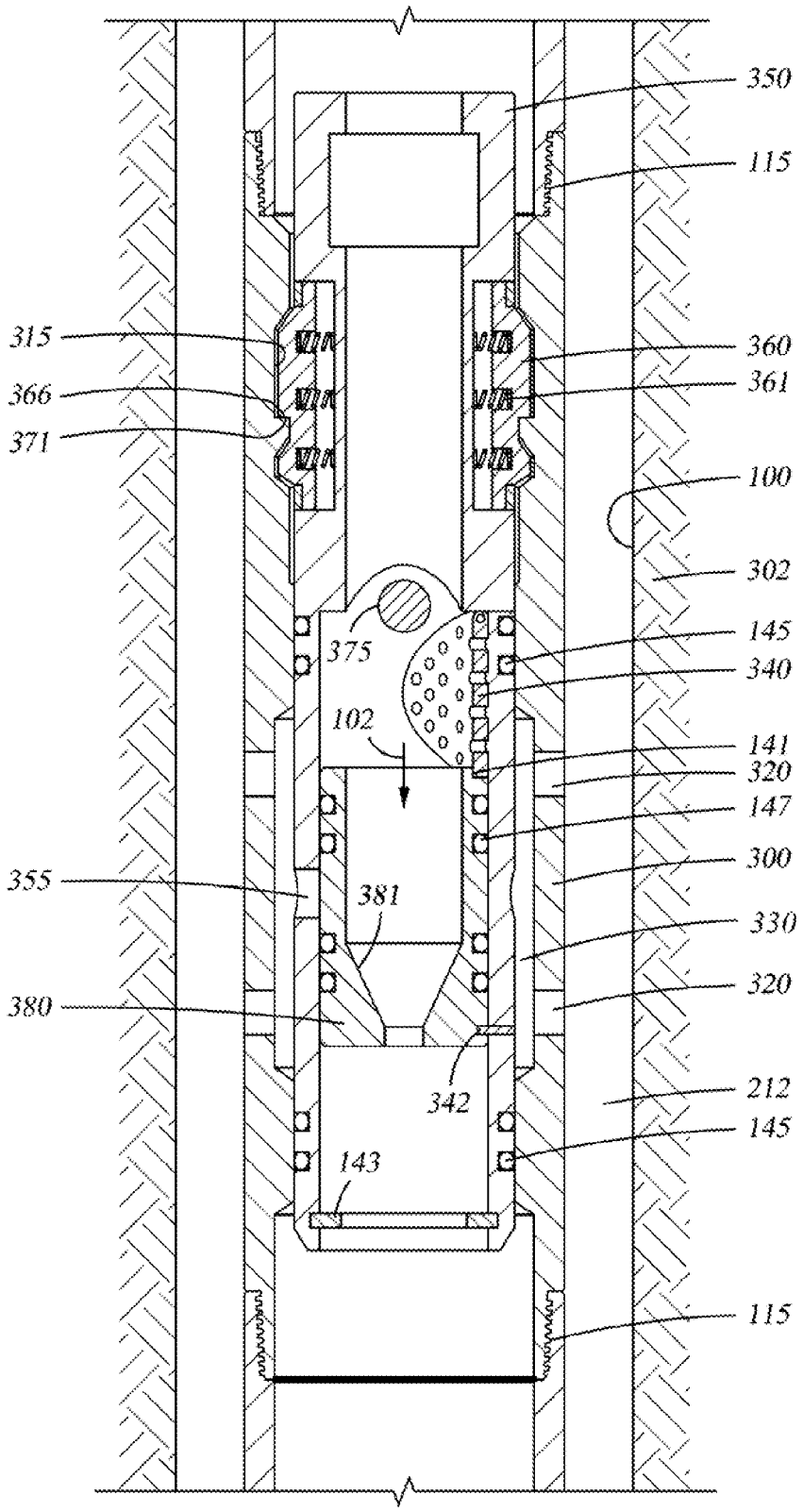
FIG. 6 is a section view of the wellbore illustrating the lower wellbore flow control insert disposed in the lower housing and showing a lower ball sleeve flow control insert plug in its initial closed position where it is retained by a shear pin.

FIG. 6 is a section view of the wellbore 100 illustrating the lower wellbore flow control insert 350 disposed in the lower housing 300 and showing a lower ball sleeve flow control insert plug 380 in its initial closed position where it is retained by a lower shear pin 342. The lower ball sleeve flow control insert plug includes a smaller diameter ball seat 381, and the smaller diameter ball 375 is shown above the seat with its direction of movement shown by arrow 102. As with the upper sleeve and wellbore flow control insert, the lower ball sleeve flow control insert plug 380 is in a position whereby a fluid path between the interior of the wellbore flow control insert and the lower zone 302 is blocked.

FIG. 7 is a section view of the components of FIG. 6 and illustrates the lower ball sleeve flow control insert plug 380 as it moves between its initial closed position to an open position. As shown, the smaller diameter ball 375 is seated in the smaller diameter ball seat 381 of the ball sleeve. Pressure is being exerted, typically from the surface of the well, and the lower shear pin 342 has been sheared due to the downward force of the fluid pressure on the ball and seat. The movement of the ball sleeve flow control insert plug 380 is shown by arrow 103 as it moves downwards in the lower wellbore flow control insert 350 towards a stop 143 designed to stop its downward movement. The spring-loaded flapper 340 is shown in its closed position with its outer edge in contact with a downwardly facing shoulder 146. The movement of the flapper is shown by arrow 104. As shown, the downward movement of the lower ball sleeve flow control insert plug 380 serves to unblock the apertures 355 formed in the lower wellbore flow control insert 350.

Figure 8:
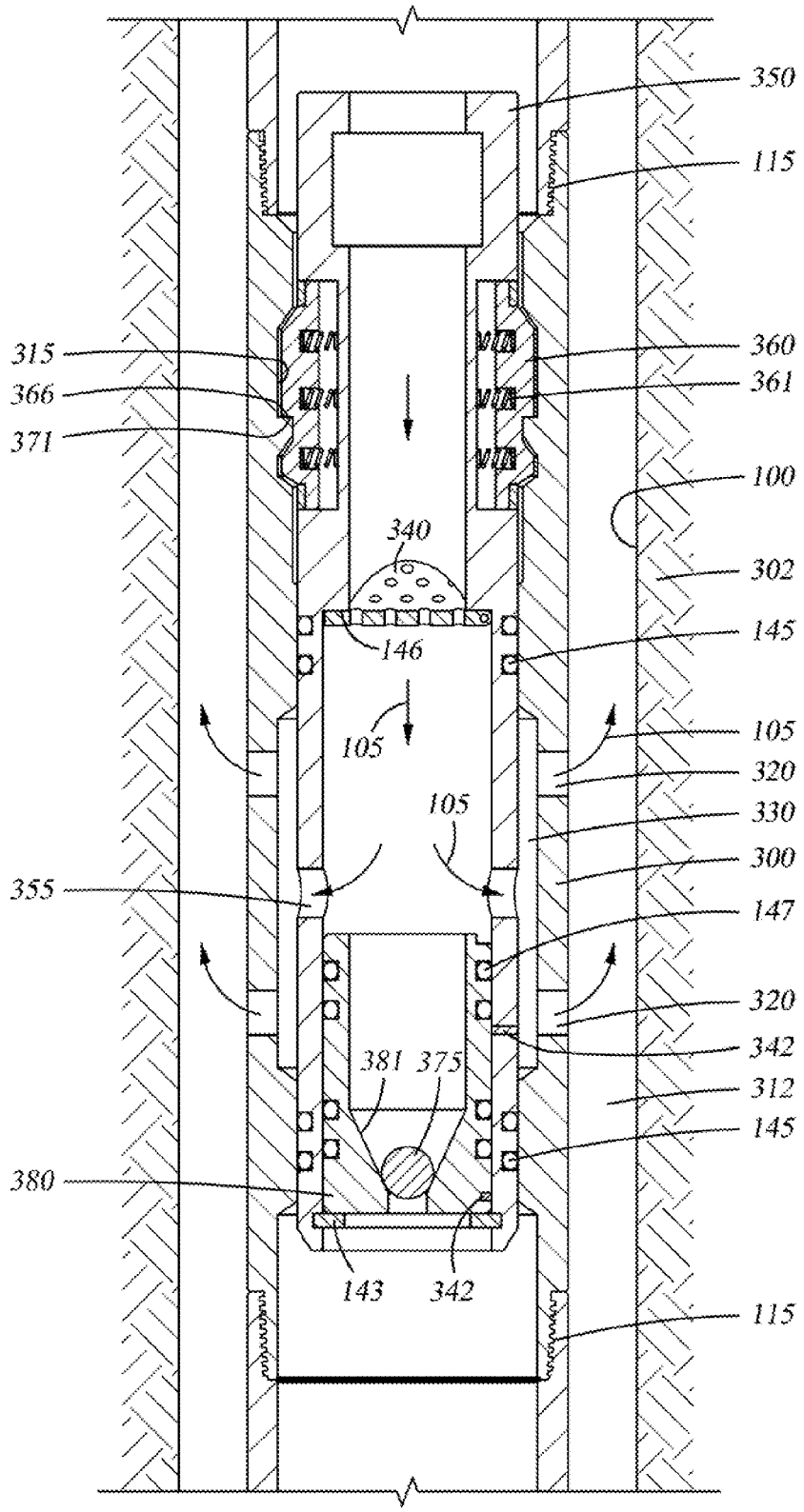
FIG. 8 is a section view of the wellbore showing the lower wellbore flow control insert and housing with the lower ball sleeve flow control insert plug in the open position and a "treatment" of the lower zone in progress.

FIG. 8 is a section view of the wellbore 100 showing the lower wellbore flow control insert 350 and lower housing 300 with the lower ball sleeve flow control insert plug 380 in the open position and a "treatment" of the lower zone 302 in progress. As shown, the ball sleeve flow control insert plug is in its open position with downward movement prevented by the stop 143. While the smaller diameter ball 375 seals a lower end of the wellbore flow control insert, a fluid path is opened from an interior of the wellbore flow control insert through the apertures 355, the annular space 330, and the ports 320 into the isolated annular area 312 adjacent the lower zone 302. The treatment material, in one embodiment, is steam injected from the surface and its migration to the zone is illustrated by arrows 105. While steam is used in the embodiment show, it will be understood that water or any other fluid or gas, like CO2 could be injected using the methods and apparatus described herein.

Figure 9:
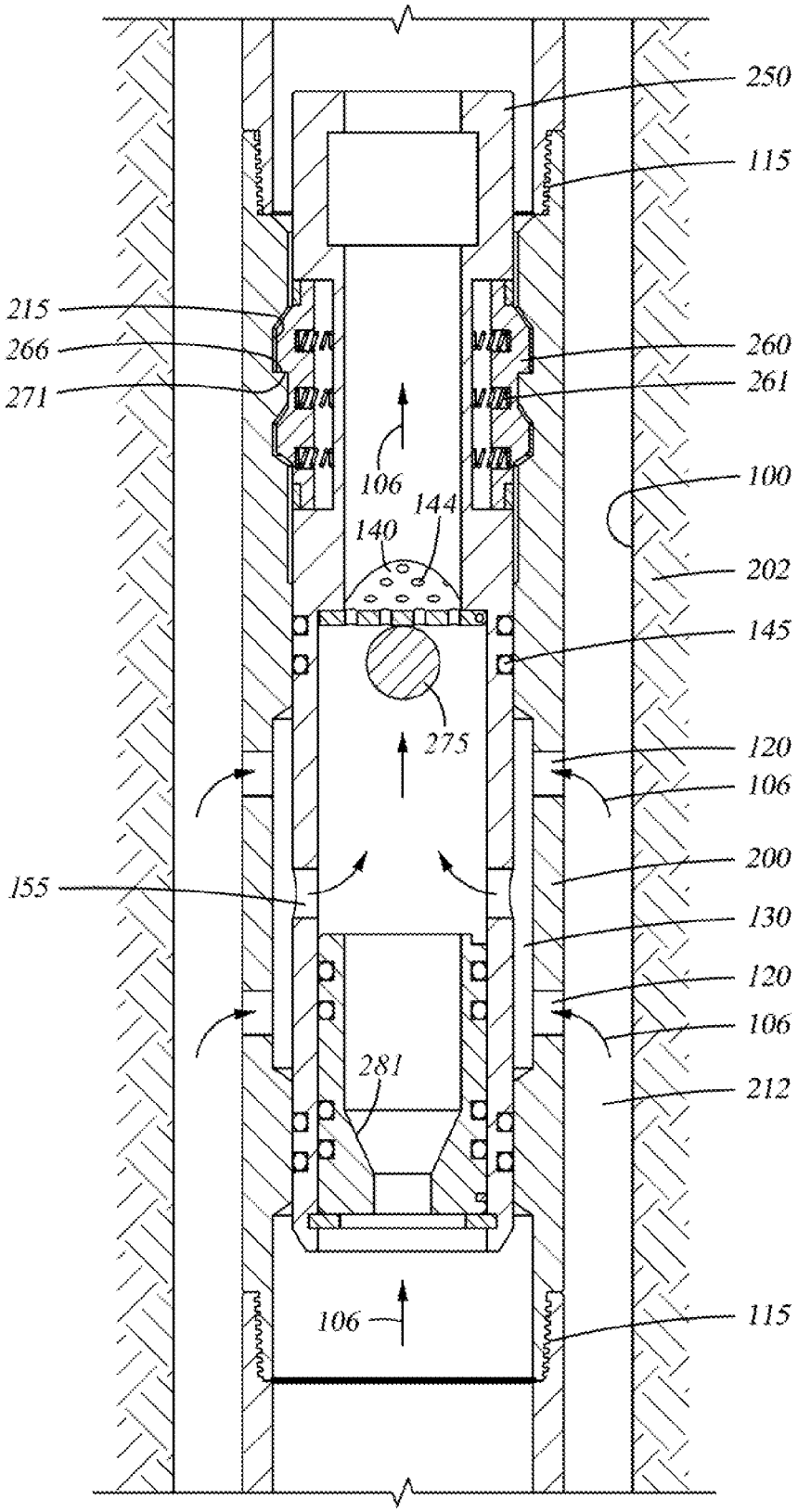
FIG. 9 is a section view of the wellbore showing the production of hydrocarbons in the upper housing and wellbore flow control insert from an upper zone as well as from zones below the upper housing.

FIG. 9 is a section view of the wellbore 100 showing the production of hydrocarbons through the upper housing 200 and upper wellbore flow control insert 250 from an upper zone 202 as well as from zones below the upper housing 200. Arrows 106 illustrate the movement of the production fluid from the zone utilizing the fluid path permitted by the ports and apertures, and arrows 107 show the movement of fluid below the zone as it flows upwards through the ball seat 281. Larger diameter ball 275, previously seated, has been displaced upwards in the wellbore flow control insert. The spring-loaded flapper 140, in its closed position, permits the ball from moving out of the wellbore flow control insert while permitting the fluid flow through it due to apertures 144 formed in its surface.

The forgoing arrangement is useful in a number of ways. In one embodiment the wellbore flow control inserts are installed one-at-a-time and that zone is treated with steam. Thereafter, another wellbore flow control insert at another location is installed and the zone treated. In another example, multiple wellbore flow control inserts are installed and then the zones are treated in a top down fashion with the balls of different diameter as discussed herein. In one example, the zones are treated at a point wherein the well has essentially stopped producing. After treatment, the zones treated produce for some amount of time without the need for further tooling or intervention. Thereafter, the zones can be re-treated or the wellbore flow control inserts can be removed and replaced by fresh ones prior to another round of steam injection.

While the foregoing is directed to embodiments of the present invention, other and further embodiments of the invention may be devised without departing from the basic scope thereof, and the scope thereof is determined by the claims that follow.

The invention claimed is:

1. A method of selectively treating different zones in a wellbore comprising:

running a tubular string into the wellbore, the string having at least two housings disposed therein, the housings separated along the string, each housing having a fluid path between an interior of the housing and a zone of interest and each housing having an individual insert profile;

running a second, smaller diameter tubular string into the wellbore, the string including an insert, the insert constructed and arranged to mate with a predetermined one of the plurality of housings and to initially seal the fluid path;

mating the insert to the predetermined housing, thereby sealing the fluid path;

dropping an object from the surface of the well, the object constructed and arranged to land in a receiving seat formed in the insert;

using fluid pressure to open the fluid path;

closing a bore of the insert using a perforated flapper to retain the object; and injecting material into the zone, via the fluid path.

2. The method of claim 1, wherein an annular area defined between each housing and its corresponding zone of interest is isolated above and below the housing.

3. The method of claim 2, wherein the object dropped from the surface is a ball and the receiving seat is a ball seat having an inside diameter smaller than an outer diameter of the ball.

4. The method of claim 3, wherein mating between the insert and the predetermined housing is due to a connection between the individual insert profile of the housing and a corresponding profile formed on keys, the keys extending from an outer surface of the insert and biased outwards.

5. The method of claim 4, wherein the fluid path is opened due to movement of a sleeve installed in the insert and movable between a first upper position within the insert and a second lower position within the insert due to the fluid pressure.

6. The method of claim 5, wherein the fluid path is opened when apertures formed in the insert and corresponding ports of the housing are in fluid communication when the sleeve is in its second, lower position.

7. The method of claim 1, further including permitting the object to pass through another insert disposed in another housing installed at a higher location in the second tubular string.

8. The method of claim 1, further including producing the well.

9. A method of selectively opening side ports in a down well tubular housing in a wellbore string comprising:

dropping a first wellbore sleeve flow control insert seal ball into the bore of the down well wellbore string, wherein said first ball is sized to seat in a first ball seat of a first sleeve flow control insert plug covering and fluid tightly sealing side ports of and longitudinally fixed to a first wellbore flow control insert by a first shear pin, wherein said first flow control insert is sealed to an inner surface of a first wellbore tubular housing having housing side ports such that said first flow control insert side ports are in fluid communication with said first tubular housing side ports when said first flow control insert is longitudinally located at and fixed to said first tubular housing at a first insert engagement position of said first tubular housing;

pressurizing said wellbore to a first side port opening pressure causing said first sleeve flow control insert plug to break said first shear pin and move downward in said first wellbore flow control insert to expose said first flow control insert side ports to thereby provide a fluid flow path from a bore of said first wellbore flow control insert through said first insert side ports and first housing side ports to an outside of said first tubular housing; and closing a bore of first wellbore flow control insert using a perforated flapper to retain the first ball.

10. The method of selectively opening side ports in a down well tubular housing in a wellbore string as in claim 9, wherein the wellbore string includes a second ball seat of a second sleeve flow control insert plug covering and fluid tightly sealing side ports of and longitudinally fixed to a second wellbore flow control insert by a second shear pin, wherein said second flow control insert is sealed to an inner surface of a second wellbore tubular housing having housing side ports such that said second flow control insert side ports are in fluid communication with said second tubular housing side ports when said second flow control insert is longitudinally located at and fixed to said second tubular housing at a second insert engagement position of said second tubular housing; wherein said second tubular housing is located above said first tubular housing in said wellbore string; wherein a diameter of the first wellbore sleeve flow control insert seal ball is sized to pass through said second ball seat of said second sleeve flow control plug in traveling to rest in said first ball seat of said first sleeve flow control insert plug.

11. The method of selectively opening side ports in a down well tubular housing in a wellbore string as in claim 10, further comprising:

dropping a second wellbore sleeve flow control insert seal ball into the bore of the down well wellbore string, wherein said second ball is sized to seat in a second ball seat of said second sleeve flow control insert plug; and after dropping said second wellbore sleeve flow control insert seal ball into the bore of the down well wellbore string; and pressurizing said wellbore to a second side port opening pressure causing said second sleeve flow control insert plug to break said second shear pin and move downward in said second wellbore flow control insert to expose said second flow control insert side ports to thereby provide a fluid flow path from a bore of said second wellbore flow control insert through said second insert side ports and second housing side ports to an outside of said second tubular housing.

12. A first wellbore component comprising:

a first tubular housing configured to connect to a wellbore string, wherein said first tubular housing has:

one or more housing side ports and a first tubular housing key receiving engagement contour on an inner surface of said first tubular housing;

a first tubular wellbore flow control insert including first housing key contour engagement key elements and a valve structure comprising one or more side apertures in a side wall of said first tubular wellbore flow control insert and a first tubular ball sleeve flow control insert plug having a central passage therethrough along a longitudinal axis thereof, said central passage including an upper bore and a lower bore wherein said upper bore is larger than said lower bore, and a first ball seat is formed between said upper bore and said lower bore;

a shear pin extending into a shear pin receiving hole in an outside surface of said first tubular ball sleeve flow control insert plug from a shear pin anchor hole in a sidewall of said first tubular wellbore flow control insert; and a hinged perforated flapper which in a closed position requires that upward fluid flow in said wellbore flow through perforations in said flapper.

13. A wellbore component comprising:

a first tubular housing configured to be connected between wellbore elements above and below when positioned in a wellbore string, wherein said first tubular housing has:

one or more housing side ports and a first tubular housing key receiving engagement contour on an inner surface of said first tubular housing;

a first tubular wellbore flow control insert including first housing key contour engagement key elements and a valve structure comprising one or more side apertures in a side wall of said first tubular wellbore flow control insert and a first tubular ball sleeve flow control insert plug having a central passage therethrough along a longitudinal axis thereof, said central passage including an upper bore and a lower bore wherein said upper bore is larger than said lower bore, and a first ball seat formed between said upper bore and said lower bore;

a shearable member extending into a shearable member receiving hole in an outside surface of said first tubular ball sleeve flow control insert plug from a shearable member anchor hole in a sidewall of said first tubular wellbore flow control insert; and a first hinged perforated flapper which in a closed position requires that upward fluid flow in said wellbore flow through perforations in said flapper.

14. The wellbore component as in claim 13, further comprising:

a first tubular ball sleeve flow control insert plug seal ball sized to seal against said first ball seat.

15. The wellbore component as in claim 14, further comprising:

a second tubular housing configured to be connected between wellbore elements above and below when positioned in a wellbore string above said first tubular housing, wherein said second tubular housing has:

one or more housing side ports and a second tubular housing key receiving engagement contour on an inner surface of said second tubular housing;

a second tubular wellbore flow control insert including second housing key contour engagement key elements and a valve structure comprising one or more side apertures in a side wall of said second tubular wellbore flow control insert; and a second tubular ball sleeve flow control insert plug having a central passage therethrough along a longitudinal axis thereof, said central passage including an upper bore and a lower bore wherein said upper bore is larger than said lower bore, and a second ball seat is formed between said upper bore and said lower bore; and a second shearable member extending into a shearable member receiving hole in an outside surface of said second tubular ball sleeve flow control insert plug from a shearable member anchor hole in a sidewall of said second tubular wellbore flow control insert.

16. A wellbore component comprising:

a first tubular housing configured to connect between wellbore elements above and below when positioned in a wellbore string, wherein said first tubular housing has:

a first tubular housing side port portion having a sidewall having one or more housing side ports, wherein each housing side port extends between an inner surface and an outer surface of said first tubular housing and a first tubular housing key receiving engagement portion having a first tubular housing insert spring loaded key element receiving contour on an inner surface of said first tubular housing;

a first tubular wellbore flow control insert having:

a valve structure comprising one or more side apertures (155) in a side wall of said first tubular wellbore flow control insert a first tubular ball sleeve flow control insert plug (280) having:

a central passage therethrough along a longitudinal axis thereof, said central passage including an upper bore and a lower bore wherein said upper bore is larger than said lower bore, wherein the ball seat section forms a conical internal surface between said upper bore and said lower bores;

a shear pin extending into a shear pin receiving hole in an outside surface of said first tubular ball sleeve flow control insert plug from a shear pin anchor hole in a sidewall of said first tubular wellbore flow control insert;

an insert plug stop fixed in a stop groove in an inside surface of said first tubular ball sleeve flow control insert below said one or more side apertures of the valve structure, and extending into an inner lower bore of said first tubular wellbore flow control insert;

a second tubular ball sleeve flow control insert plug activation ball, having a diameter smaller than said lower bore of said first tubular ball sleeve flow control insert plug, allowing it to pass through said lower bore of said first tubular ball sleeve flow control insert plug;

a first tubular ball sleeve flow control insert plug activation ball, having a diameter smaller than said upper bore and smaller than said lower bore of said first tubular ball sleeve flow control insert plug, such that when positioned against said conical internal surface of said ball seat section causes said lower bore to be sealed thereby preventing downward fluid flow through said first tubular ball sleeve flow control insert plug; and a spring loaded perforated flapper fixed through a hinge to said first tubular wellbore flow control insert and held in an insert bore open position by engagement with a flapper tip retaining shoulder of an upper end said first tubular ball sleeve flow control insert plug and when released by disengagement from said flapper tip retaining shoulder of said upper end said first tubular ball sleeve flow control insert plug hinges upwardly to cover said insert bore, thereby allowing fluid flow upward therethrough and preventing movement of one or more tubular ball sleeve flow control insert plug activation balls upward past the position of said perforated flapper covering said insert bore.

17. A method of selectively treating different zones in a wellbore comprising:

running a tubular string into the wellbore, the string having a housing disposed therein, the housing having a fluid path between an interior of the housing and a zone of interest and having a profile for mating with an insert;

running a second, smaller diameter tubular string into the wellbore, the string including the insert, the insert constructed and arranged to mate with the profile and to initially seal the fluid path;

mating the insert to the profile, thereby sealing the fluid path;

landing an object in a receiving seat formed in the insert;

using fluid pressure to open the fluid path;

retaining the object in the insert using a perforated flapper; and injecting material into the zone, via the fluid path.

18. The method of claim 17, wherein an annular area defined between the housing and the zone of interest is isolated above and below the housing.

19. The method of claim 17, wherein the object dropped from the surface is a ball and the receiving seat is a ball seat having an inside diameter smaller than an outer diameter of the ball.

20. The method of claim 17, wherein mating between the insert and the predetermined housing is due to a connection between the individual profile of the housing and a corresponding profile formed on keys, the keys extending from an outer surface of the insert and biased outwards.

21. The method of claim 17, wherein the fluid path is opened due to movement of a sleeve installed in the insert and movable between a first upper position within the insert and a second lower position within the insert due to the fluid pressure.

22. The method of claim 17, wherein the fluid path is opened when apertures formed in the housing and corresponding ports of the insert are in fluid communication when the sleeve is in its second, lower position.

23. The method of claim 17, further comprising permitting the object to pass through another insert disposed in another housing installed at a higher location in the second tubular string.

24. The method of claim 17, further comprising producing the well.

25. The method of claim 17, wherein the perforated flapper closes in response to opening of the fluid path due to movement of the sleeve.

* * * * *